United States Patent [19]

Kawamura et al.

[11] 4,391,016

[45] Jul. 5, 1983

[54] DEGREASING APPARATUS FOR ELONGATED MATERIALS

[75] Inventors: Teruaki Kawamura; Nobuhiko Harada; Yukihiko Komatsu; Masaru Sakai, all of Shimonoseki, Japan

[73] Assignee: Kabushiki Kaisha Kobe Seiko Sho, Kobe, Japan

[21] Appl. No.: 302,135

[22] Filed: Sep. 14, 1981

[30] Foreign Application Priority Data

Oct. 14, 1980 [JP] Japan ..... 55-146429[U]

[51] Int. Cl.[3] ..... B21B 45/02

[52] U.S. Cl. ..... 15/302; 15/306 A; 15/308

[58] Field of Search ..... 15/302, 306 A, 308, 15/309

[56] References Cited

U.S. PATENT DOCUMENTS

| | | | |
|---|---|---|---|
| 1,575,526 | 3/1926 | Böcher | 15/302 X |
| 3,044,098 | 7/1962 | Stalson | 15/302 |
| 3,653,425 | 4/1972 | Elliott et al. | 15/302 X |
| 4,073,029 | 2/1978 | Vassallo | 15/302 |
| 4,129,919 | 12/1978 | Fitch et al. | 15/302 |
| 4,312,094 | 1/1982 | Daverio et al. | 15/302 |

*Primary Examiner*—Chris K. Moore

*Attorney, Agent, or Firm*—Oblon, Fisher, Spivak, McClelland & Maier

[57] ABSTRACT

A degreasing apparatus for an elongated member including a treatment room sequentially divided in an isolated fashion and along the feeding direction of the elongated member into a degreasing chamber, a predrying chamber and a finish drying chamber. At least one pair of rotary brushes are provided in the degreasing chamber. The degreasing chamber is also provided with means for jetting out a degreasing liquid in a direction toward the inlet side of a contact area between the brushes and elongated mechanism. Elastic degreasing members are provided, respectively, at the inlet and outlet sides of the degreasing chamber to remove oil or grease from the elongated member before it enters the degreasing chamber and to wipe off any degreasing liquid remaining on the elongated member prior to passing the same into the predrying chamber. The predrying chamber houses a mechanism for jetting out water or steam against the elongated member while the finish drying chamber is provided with a mechanism to blow hot air against the elongated material and to dry it completely. The above degreasing apparatus can be formed in a reduced size and convenient for coupling with drawing machine and/or roller straightening machine, thus enabling continuous treatment of elongated members. Owing to the mutual isolation of the chambers, their respective treatment media can be saved and the overall processing efficiency can be improved.

11 Claims, 6 Drawing Figures

DEGREASING APPARATUS FOR ELONGATED MATERIALS

BACKGROUND OF THE INVENTION

1. Field of the Invention

This invention relates to a degreasing apparatus for elongated members and its principal object is to provide a degreasing apparatus capable of performing sure and easy degreasing of oil, grease films or the like attached on the surfaces of elongated members and achieving a size reduction of the overall apparatus for convenience in coupling the apparatus to its preceding and/or subsequent processing or machining apparatus such as, for example, a drawing machine and roller straightening machine.

2. Description of the Prior Art

When an elongated metallic member is subjected to plastic processing, a lubricant is employed whether the material is a solid rod or hollow rod. Thus, as has already been known, it is important in the quality of the final product to remove as a post treatment stains or films of oil or grease such as the lubricant. Particularly, such a degreasing treatment is indispensable for raw materials made of zirconium or a zirconium alloy as such raw materials tend to develop pits, ruggedness or uneveness on their surfaces, or white spots on their surfaces during treatment in a final autoclave. This degreasing has conventionally been carried out principally by simply throwing them into a degreasing liquid. However, such a conventional degreasing method is not only insufficient to completely degrease the members but also constitutes an obstacle for automation of the production process, thereby resulting in a main cause for inefficient productivity.

SUMMARY OF THE INVENTION

With the foregoing in view, the present invention has been completed as a result of extensive research. According to the present invention, there is provided a degreasing apparatus for an elongated member. The apparatus includes a treatment room sequentially divided in an isolated fashion and along the feeding direction of the elongated member into a degreasing chamber, a predrying chamber and a finish drying chamber, at least one pair of rotary brushes provided in the degreasing chamber in such a manner that the brushes are brought into contact with the outer surface of the elongated material, a mechanism disposed in the degreasing chamber for jetting out a degreasing liquid in a direction toward the inlet side of a contact area between the brushes and elongated material, degreasing members provided, respectively, at the inlet and outlet sides of the degreasing chamber along an axis on which the elongated member is fed, each of the degreasing members being made of an elastic material and defining an opening for permitting said elongated member to be forceably passed therethrough, a mechanism provided in the predrying chamber for jetting out water or stream against the elongated material, and mechanism installed in the finish drying chamber for jetting out a drying medium of hot air against the elongated member.

In a preferred embodiment, the mechanism for jetting out water or steam and the mechanism for jetting out the drying medium of hot air each are an annular nozzle unit surrounding annularly the axis and have a plurality of nozzle openings. The degreasing members are preferably provided with mechanism for preventing the degreasing liquid from leaking out of the degreasing chamber through the members. In another preferred embodiment, a finishing wipe-off device made of an elastic member is provided at the outlet side of the finish drying chamber on the feeding axis of the elongated member. The finishing wipe-off device is preferably provided with a mechanism for preventing the drying medium of hot air from leaking out of the finish drying chamber through the wipe-off device.

Although the apparatus according to this invention is most effective when used for raw materials such as zirconium or zirconium alloy which requires a strict degreasing, it is to be understood that it can also be applied to both solid and hollow elongated members of stainless steel or other metals.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
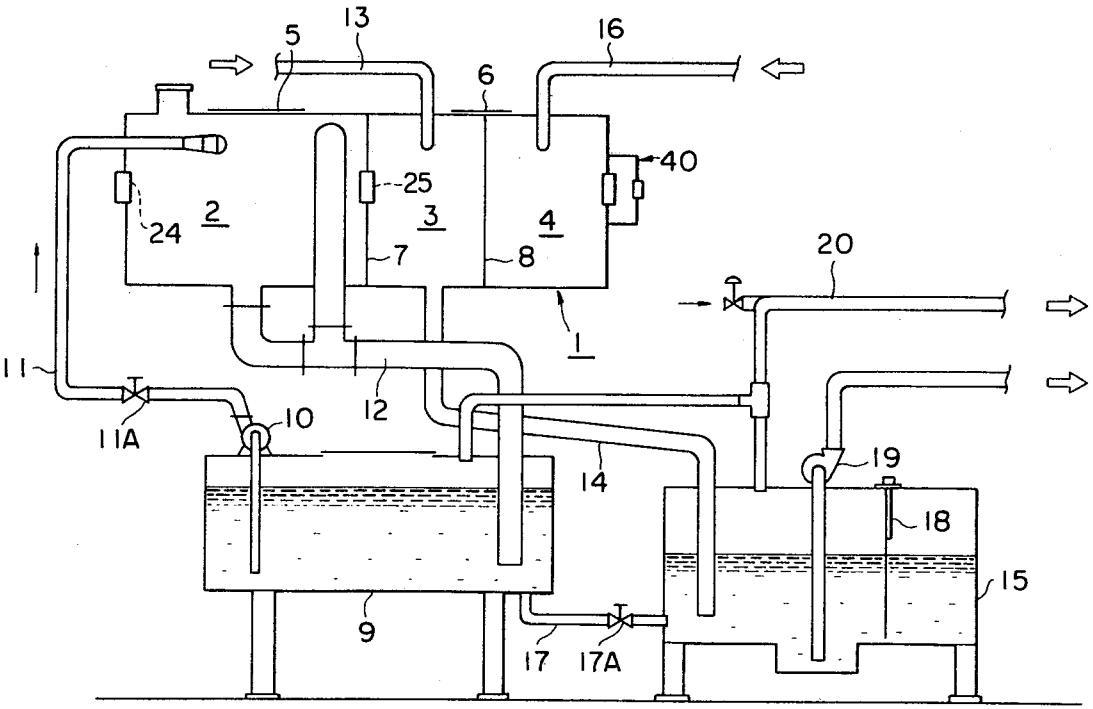
FIG. 1 is a diagrammatic overall illustration of a degreasing apparatus embodying this invention.

Referring first to FIG. 1, a treatment room 1 has a rectangular box-shaped structure and is divided in an isolated fashion into a degreasing chamber 2, a predrying chamber 3 making use of water, steam or the like, and a finish drying chamber 4 using hot air as its drying medium. Treatment room 1 is provided on its upper wall with lids 5, 6 adapted to operably open or close their respective openings for inspection of the treatment room 1 or for watching the treatment of an elongated member to be fed therethrough. Treatment room 1 is divided into equal two halves by means of a partition wall 7. The rear half is divided further by another partition wall 8. As apparent from the drawing, the treatment room 1 is divided in the feeding direction of the elongated material, in other words, in the direction from left to right on the drawing.

To degreasing chamber 2 can be supplied a degreasing liquid stored in a degreasing liquid tank 9 can be supplied by a feed liquid pump 10 through a feed liquid pipe 11 equipped with a valve 11A. The degreasing liquid may be recycled from the degreasing chamber 2 to the degreasing liquid tank 9 through a discharge pipe 12. On the other hand, steam, water or the like can be supplied to the predrying chamber 3 through a feed pipe 13 while making it possible to drain the thus-supplied steam, water or the like into an effluent reservoir 15 through a discharge pipe 14. The finish drying chamber 4 can be fed under pressure with a drying medium of hot air via a feed pipe 16.

The degreasing liquid tank 9 and effluent reservoir 15 are connected near the respective bottoms thereof by means of a communication pipe 17 equipped with a valve 17A. A level switch 18 is provided with the effluent reservoir 15 to detect the level of the effluent held in the reservoir 15. The effluent reservoir 15 is also provided with a feed liquid pump 19 so as to send the effluent to a pit (not shown). Any odor, which may be developed in the degreasing liquid tank 9 and effluent reservoir 15, can be exhausted into the open air by pressurized air or the like charged through a deodorizing mechanism 20.

Next, reference is made to the remaining drawings, i.e., FIGS. 2 through 6. The treatment room 1 is installed in the so-called laid position by means of supporting columns 21. In the degreasing chamber 2 are provided at least one pair of rotary brushes 22 which can be brought into contact with the entire outer surface of an elongated member A as well as a jet nozzle unit 23 for directing the degreasing liquid to the inlet side of a contact area between the brushes 22 and elongated member A.

In the illustrated embodiment, the jet nozzle unit 23 is detachably communicated with the feed liquid pipe 11 and is provided at an upper location in the degreasing chamber 2. The nozzle unit 23 is directed to the inlet side of the brushes 22. The rotary brushes 22 are forcedly rotated inwardly in a direction opposite to the feeding direction of the member A.

At the inlet and outlet sides of the degreasing chamber 2 are provided, respectively, degreasing rings 24, 25 made of an elastic material on the feeding axis of the elongated member A. Numerals 26, 27 represent their respective fixtures, namely, the fixture 26 is mounted on the inlet-side wall 2A of the degreasing chamber 2 while the fixture 27 is provided on the outlet-side wall of the degreasing chamber 2 or, in other words, the partition wall 7.

Figure 3:
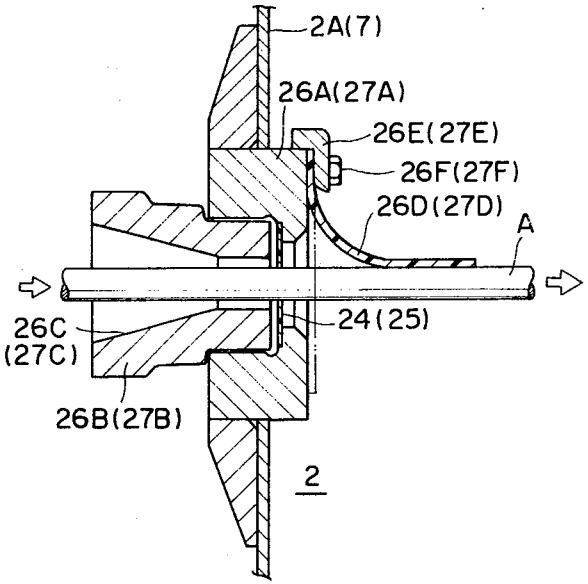
FIG. 3 is an enlarged cross-sectional view of a part indicated by letter B in FIG. 2.

Since the degreasing rings 24, 25 and fixtures 26, 27 are the same in structure, their specific features will be described with reference to those provided at the inlet side depicted in FIG. 3. An internally threaded cylindrical body 26A is fixedly secured in the wall 2A, in which cylindrical body 26A is threaded an externally threaded cylindrical body 26B defining a tapered guide portion 26C. The degreasing ring 24 is held in place between the proximal end face of the externally threaded cylindrical body 26B and a stepped portion of the internally threaded cylindrical body 26A, thereby allowing wiping off with the so-called squeezing action of any oil or grease attached on the outer surface of the elongated material A by the inner peripheral edge of the degreasing ring 24.

A flexible plate 26D is attached by a holder 26E and bolt 26F to the end face at the material feeding-out side of the internally threaded cylindrical body 26A so as to close the bore of the body 26A. In FIG. 3, corresponding reference numerals for the outlet-side fixture 27 are indicated in brackets and their description will be omitted herein.

Figure 5:
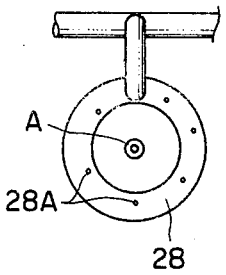
FIG. 5 is an enlarged view seen in the direction indicated by arrows V—V in FIG. 2.

In the predrying chamber 3 is housed an annular nozzle unit 28 which is in communication with the feed pipe 13. Unit 28 concentrically and annularly surrounds the feeding axis of the elongated member A as shown in FIG. 5, and includes, as depicted in FIG. 2, a plurality of nozzle openings 28A for jetting out steam or the like against the elongated member A in directions opposite and oblique to the feeding direction of the member A.

Figure 6:
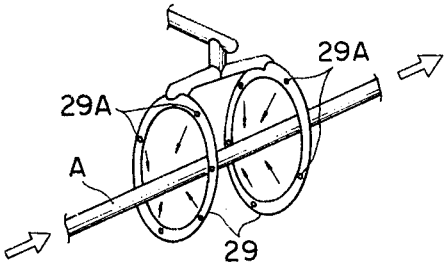
FIG. 6 is a perspective view of a part generally indicated by letter D in FIG. 2.

Finish drying chamber 4 houses an annular nozzle unit 29 communicated with the feed pipe 16. In the illustrated embodiment, the nozzle unit 29 has double nozzle rings spaced from each other in the feeding direction of the member A and, as best shown in FIG. 6, surrounds the feeding axis so as to jet out the drying medium of hot air against the elongated member A in directions opposite and oblique to the feeding direction of the member A. Numerals 29A indicate a plurality of jet nozzle openings of the nozzle unit 29.

Figure 2:
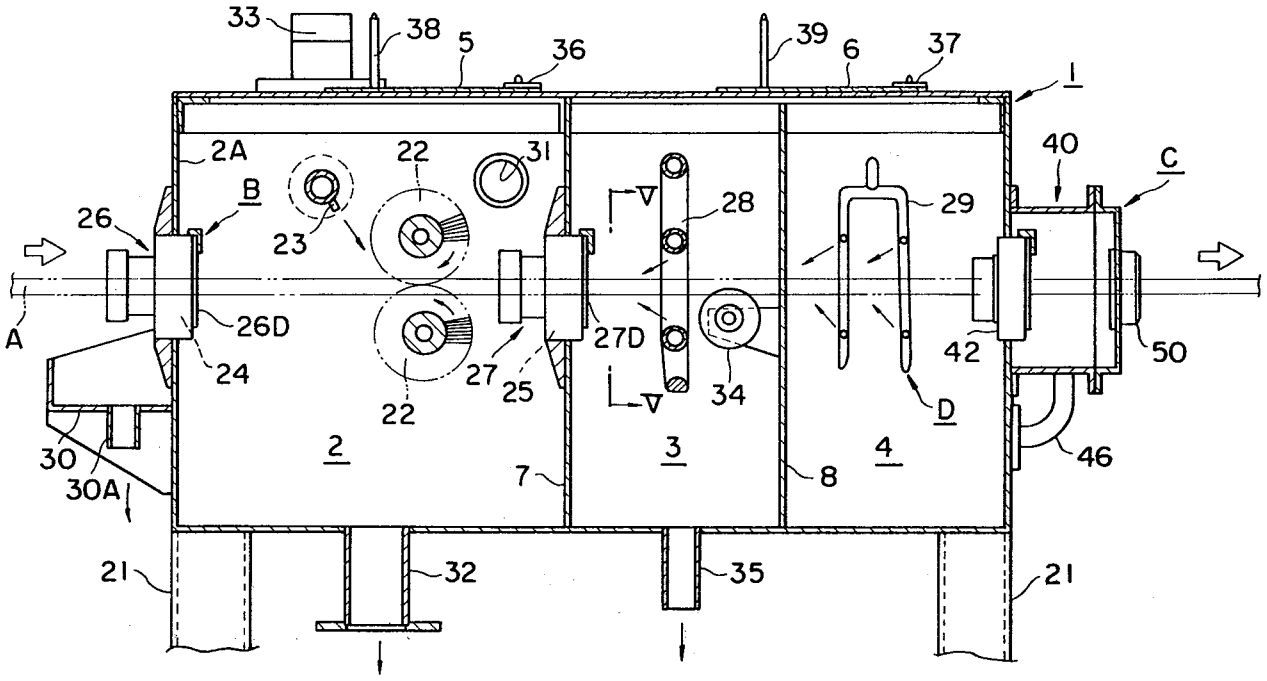
FIG. 2 is a longitudinal cross-sectional elevation showing the interior of a treatment room.

Besides the aforementioned devices and members, in FIG. 2, designated by reference numeral 30 is a catching trough which is provided on the inlet-side wall 2A. Catching trough 30 serves to receive oil, grease or the like which has been wiped off by the degreasing ring 24 and to receivingly drop the same into an unillustrated container through a discharge cylinder 30A. Reference numeral 31 indicates a foam drainage opening which is formed on a side wall of the degreasing chamber 2 at an upper location in the vicinity of the rotary brushes (22). The discharge pipe 12 is connected to the opening 31 and a discharge cylinder 32 provided by the bottom of the degreasing chamber 2. Designated at reference numeral 33 is a vent opening.

In FIG. 2, reference numeral 34 indicates a guide roller for the elongated member A, which is provided on the partition wall 8 so as to guide the elongated material A while supporting the same. Designated by reference numeral 35 is a discharge cylinder for steam, water or the like, to which the discharge pipe 14 is coupled. Reference numerals 36, 37 indicate hinges of the lids 5, 6, respectively, while their handles are indicated by reference numerals 38, 39.

In FIG. 1, reference numeral 40 indicates generally a finishing wipe-off device installed at the finish drying chamber 4. It is constructed as depicted in FIG. 4.

Figure 4:
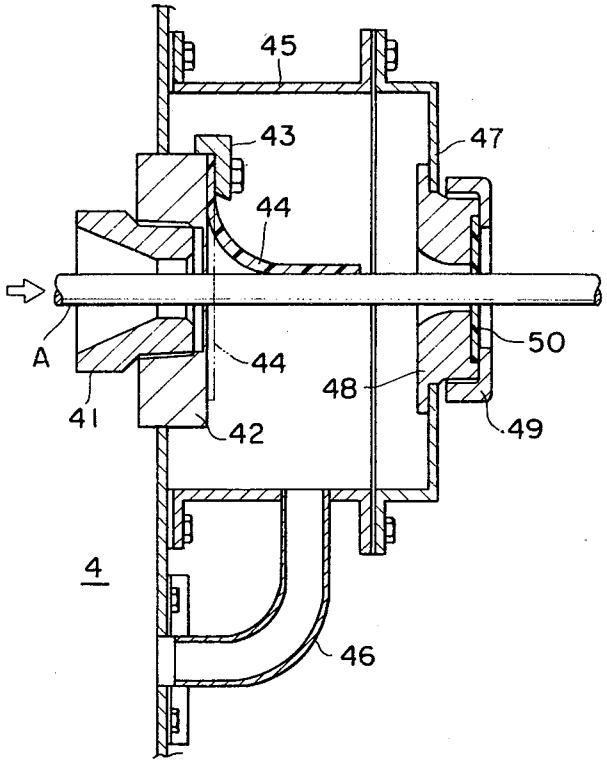
FIG. 4 is an enlarged cross-sectional view of a part indicated by letter C in FIG. 2.

In FIG. 4, reference numeral 42 indicates an internally threaded cylindrical body on which an externally threaded cylindrical body 41 is screwed concentrically with the feeding axis of the elongated member A. Cylindrical body 42 is provided with a flexible plate 44 via a holder 43 for operably opening or closing the bore of the cylindrical body 42. On the rear wall of the finish drying chamber 4, a casing 45 is detachably mounted so as to cover the above-described flexible plate 44, etc. Casing 45 is communicated with the finish drying chamber 4 by means of an elbow 46. A lid 47 is detachably provided on the end surface of the casing 45. Furthermore, an externally threaded cylindrical body 48 is fixed in the lid 47 on the feeding axis of the elongated body A. A wipe-off ring 50 made of an elastic member is held between the lead end face of the cylindrical body 48 and a corresponding internally threaded cylindrical cap 49.

In the embodiment constructed as described above, the elongated member A is introduced into the treatment room 1 by means of a long material feeder (not shown) from the left side in FIG. 2 and transported out of the treatment room 1 to the right side. Where the elongated member A is a pipe, it is charged into the treatment room 1 with plugs fitted in both end portions of the pipe.

The thus-introduced elongated member A is wiped at the inlet side of the degreasing chamber 2 by the degreasing ring 24 so as to remove oil, grease or the like attached on the outer surface of the member A and to receive the same in the catching trough 30. Subsequently, the elongated member A is subjected to a degreasing treatment by jetting out the degreasing liquid from the jet nozzle unit 23 while driving the rotary brushes 22.

Since the degreasing liquid is jetted out toward the inlet side of the contact area between the rotary brushes 22 and elongated member A, the degreasing operation is carried out by the rotary brushes 22 immediately after the jetting out of the degreasing liquid, thereby ensuring an efficient degreasing. Foam, which occurs through the degreasing operation, is discharged through the foam drainage opening 31 while the used degreasing liquid mixed with oil or grease is drained through the discharge cylinder 32 and combined with the foam in the discharge pipe 12.

Although some degreasing liquid still remains on the elongated member A which has been subjected to the aforementioned degreasing operation by the rotary brushes 22, this remaining greasing liquid can be wiped off by the ring 25 provided at the outlet side of the degreasing chamber 2.

Any degreasing liquid still remaining on the elongated material A, which has passed through the degreasing chamber 2, is blown off by water or steam jetted out from the nozzle openings 28A while passing through the annular nozzle unit 28 provided on the feeding axis of the elongated member A in the predrying chamber 3. Thereafter, when passing through the annular nozzle unit 29 in the finish drying chamber 4, the elongated member A is forcedly dried by the drying medium of hot air blown out from the nozzle openings 29A. Even if the drying of the elongated member A should be insufficient, the elongated member A is wiped by the ring 5. Scattering of the degreasing liquid into the chambers other than the degreasing chamber 2 due to the jetting out from the nozzle unit 23 and revolution of the rotary brushes 22 can be avoided owing to the isolated division of the degreasing chamber 2 and predrying chamber 3. Furthermore, it is possible to prevent admixture of the different materials jetted out of the annular nozzle units 28, 29 as the predrying chamber 3 is isolated from the finish drying chamber 4. In the present embodiment, the provision of the flexible plates 26D, 27D, 44 serves to prevent any foreign materials from getting into the chambers 2, 3, 4 and to the treatment media from leaking out from their respective chambers while permitting the passage of the elongated members A therethrough. Thus, no problem would arise even if the degreasing liquid, steam and drying medium of hot air are continually fed to improve the efficiency of the degreasing treatment.

Since the degreasing apparatus according to this invention is constructed as described above, the following merits have been brought about:

Owing to the provision of the degreasing ring 24 at the inlet side of the degreasing chamber 2, it is possible to remove to a considerable extent oil, grease or the like attached on the elongated member A prior to degreasing it with the degreasing liquid, thereby saving the degreasing liquid.

The outer surface of the elongated member A can be degreased promptly and efficiently by the brushes 22 immediately after applying the degreasing liquid on the outer surface, because the nozzle unit 23 for the degreasing liquid is directed toward the inlet side of the contact area between the rotary brushes 22 and elongated member A.

Since the ring 25 is provided at the outlet side of the degreasing chamber 2 and the degreasing liquid is thus prevented from being carried into the predrying chamber 3 and finish drying chamber 4 while being attached on the elongated member A, it is possible to contemplate perfect degreasing of the elongated member A while performing the so-called blowing-off of any remaining degreasing liquid by the medium jetted out from the nozzle unit 28 and cleaning the member A in the predrying chamber 3 as well as subsequently subjecting the thus-predried elongated member A to a finishing treatment through the complete drying of any attached water by the drying medium blown out of the nozzle unit 29 provided in the finish drying chamber 4, thereby enabling continuous degreasing treatment.

In addition, the degreasing chamber 2, predrying chamber 3 and finish drying chamber 4 are isolated from one another. Therefore, it is possible to reduce the size of the degreasing apparatus while preventing any mutual contamination of the different materials to be used in their respective chambers. The apparatus of this invention can be coupled with a roller straightening machine, drawing machine, etc., thus enabling continuous processing.

Although two rotary brushes 22 are provided in the above-described embodiment, it is also feasible to use three or more brushes, or to dispose two pairs of brushes one pair after the other pair in the feeding direction of the elongated member A. Furthermore, a plurality of annular predrying nozzle units 28 may be provided in the feeding direction and the annular finish drying nozzle unit 29 may be made of a single nozzle ring. It should be understood that the jetting direction of medium from each nozzle is not be limited to that shown in the drawings but the steam and hot air may be blown perpendicularly to the feeding axis or in the feeding direction. The rotary brushes 22 may be driven in directions opposite to those shown in the drawings.

Having now fully described the invention, it will be apparent to one of ordinary skill in the art that many changes and modifications can be made thereto without departing from the spirit or scope of the invention as set forth herein.

What is claimed is:

1. A degreasing apparatus for degreasing an elongated member comprising:

a treatment room having a plurality of chambers sequentially divided in an isolated fashion along a feeding direction of the elongated member wherein said plurality of chambers comprise a degreasing chamber, a predrying chamber and a finish drying chamber;

at least one pair of rotary brushes provided in the degreasing chamber such that said brushes are maintained in contact with an outer surface portion of the elongated member;

means disposed in the degreasing chamber for jetting out a degreasing liquid in a direction toward the inlet side of a contact area between said brushes and said elongated member;

a plurality of degreasing members provided, respectively, at the inlet and outlet sides of the degreasing chamber along an axis on which the elongated material is fed, wherein each of said degreasing members comprises an elastic material and defines an opening for permitting said elongated member to forceably pass therethrough;

means disposed in said predrying chamber for jetting out water or steam against the elongated material; and means mounted in said finish drying chamber for jetting out a drying medium of hot air against the elongated member.

2. The degreasing apparatus as claimed in claim 1, wherein said means for jetting out water or steam and said means for jetting out the drying medium of hot air each further comprise an annular nozzle unit annularly surrounding said axis and having a plurality of nozzle openings formed therein.

3. The degreasing apparatus as claimed in claim 1 or 2, wherein said degreasing members each further comprise means for preventing the degreasing liquid from leaking out of the degreasing chamber therethrough.

4. The degreasing apparatus as claimed in claim 3, wherein said means for preventing the degreasing liquid from leaking out of the degreasing chamber further comprises a flexible plate.

5. The degreasing apparatus as claimed in claim 1, further comprising a finishing, wipe-off device which comprises an elastic material and which is positioned at the outlet side of the finish drying chamber on said axis.

6. The degreasing apparatus as claimed in claim 5, wherein said finishing wipe-off device further comprises means for preventing the medium of hot air from leaking out of the finish drying chamber through the wipe-off device.

7. The degreasing apparatus as claimed in claim 6, wherein the means for preventing the medium of hot air from leaking out of said finish drying chamber further comprises a flexible plate.

8. The degreasing apparatus as claimed in claim 1, 2 or 5 wherein said degreasing chamber further comprises a side wall and further comprising a foam drainage opening defined in said side wall of said degreasing chamber at an upper location adjacent the rotary brush.

9. The degreasing apparatus as claimed in claim 1, 2 or 5, further comprising means for rotating said said rotary brushes in a direction opposite to the feeding direction of the elongated material.

10. The degreasing apparatus as claimed in claim 1, 2 or 5, wherein said means for jetting said water or steam and said medium of hot air further comprises means for jetting said water or steam and said medium of hot air against said elongated material in a direction opposite to the feeding direction of the elongated material.

11. The degreasing apparatus as claimed in claim 1, 2 or 5, wherein said degreasing members further comprise degreasing rings.

* * * * *

UNITED STATES PATENT AND TRADEMARK OFFICE

CERTIFICATE OF CORRECTION

PATENT NO. : 4,391,016

DATED : JULY 5, 1983

INVENTOR(S) : KAWAMURA, TERUAKI; HARADA, NOBUHIKO; KOMATSU, YUKIHIKO; and KABUSHIKI KAISHA KOBE SEIKO SHO It is certified that error appears in the above-identified patent and that said Letters Patent is hereby corrected as shown below:

On the title page, column 1, line 4, delete "MATERIALS" and insert therefor --MEMBER--;

In the Abstract, line 20, delete "material" and insert therefor --member--;

In column 1, line 3, delete "MATERIALS" and insert therefor --MEMBER--;

In column 1, line 60, delete "stream" and insert therefor --steam--;

In column 2, line 12, after "requires" delete "a";

In column 2, line 56, delete "material" and insert therefor --member--;

In column 4, line 24, delete "by" and insert therefor --at--;

In column 4, line 25, delete "at" and insert therefor --by--;

UNITED STATES PATENT AND TRADEMARK OFFICE

CERTIFICATE OF CORRECTION

PATENT NO. : 4,391,016

DATED : JULY 5, 1983

INVENTOR(S) : KAWAMURA, TERUAKI; HARADA, NOBUHIKO; KOMATSU, YUKIHIKO; and KABUSHIKI KAISHA KOBE SEIKO SHO It is certified that error appears in the above-identified patent and that said Letters Patent is hereby corrected as shown below:

In column 4, line 30, delete "material" and insert therefor --member--;

In column 5, line 20, delete "greasing" and insert therefor --degreasing--;

In column 6, line 35, delete "is" and insert therefor --to--;

In column 6, line 65, delete "material" and insert therefor --member--;

In column 7, line 2, delete "material" and insert therefor --member--;

In column 8, line 14, delete the last "said";

In column 8, line 16, delete "material" and insert therefor --member--;

In column 8, line 21, delete "material" and insert therefor --member--;

UNITED STATES PATENT AND TRADEMARK OFFICE

CERTIFICATE OF CORRECTION

PATENT NO. : 4,391,016

DATED : JULY 5, 1983

INVENTOR(S) : KAWAMURA, TERUAKI; HARADA, NOBUHIKO; KOMATSU, YUKIHIKO; and KABUSHIKI KAISHA KOBE SEIKO SHO It is certified that error appears in the above-identified patent and that said Letters Patent is hereby corrected as shown below:

In column 8, line 22, delete "material" and insert therefor --member--.

Signed and Sealed this

First Day of May 1984

[SEAL]

*Attest:*

GERALD J. MOSSINGHOFF

*Attesting Officer*

*Commissioner of Patents and Trademarks*